US006119780A

United States Patent [19]

Christmas

[11] Patent Number: 6,119,780

[45] Date of Patent: Sep. 19, 2000

[54] WELLBORE FLUID RECOVERY SYSTEM AND METHOD

[75] Inventor: David A. G. Christmas, Milltimber, United Kingdom

[73] Assignee: Camco International, Inc., Houston, Tex.

[21] Appl. No.: 08/988,620

[22] Filed: Dec. 11, 1997

[51] Int. Cl.[7] ..... E21B 43/14

[52] U.S. Cl. ..... 166/313; 166/50; 166/53; 166/66.4; 166/105

[58] Field of Search ..... 166/313, 369, 166/105, 50, 66.4, 53

[56] References Cited

U.S. PATENT DOCUMENTS

| | | | |
|---|---|---|---|
| 2,242,166 | 5/1941 | Bennett | 166/105 |
| 3,326,292 | 6/1967 | Young et al. | 166/106 |
| 3,901,811 | 8/1975 | Finch | 210/538 |
| 5,335,732 | 8/1994 | McIntyre | 166/313 |
| 5,706,896 | 1/1998 | Tubel et al. | 166/313 |
| 5,862,863 | 1/1999 | Swisher | 166/313 |
| 5,881,814 | 3/1999 | Mills | 166/313 |
| 5,884,704 | 3/1999 | Longbottom et al. | 166/313 |

*Primary Examiner*—Hoang Dang
*Attorney, Agent, or Firm*—Fletcher, Yoder & Van Someren

[57] ABSTRACT

A wellbore fluid recovery system for recovering fluid from a wellbore that has at least one lateral wellbore extending out therefrom. The system includes a first electric submergible pumping system for recovering fluids from a first zone of a wellbore, and a second electric submergible pumping system for recovering fluids from a second zone of the wellbore, such as from a lateral wellbore. Automated control mechanisms are used for independently regulating fluid flow from the first and the second electric submergible pumping systems. Such control mechanisms include automated downhole adjustable valves and variable speed electric motor controllers.

13 Claims, 2 Drawing Sheets

48
C
34
36
40
24
50
26
P
Gs
Pr
M
S
OPTIONAL ADDITIONAL PUMPING UNIT
30
42
36
40
50
28
M
Pr
P
S
38
34
46
42
30
36
28
50
P
Pr
M
S
32
44
42

WELLBORE FLUID RECOVERY SYSTEM AND METHOD

BACKGROUND OF THE INVENTION

1. Field of the Invention

The present invention relates to systems used for recovering fluids from subterranean wellbore and, more particularly, to systems that use multiple pumps to recover fluids from multiple subterranean earthen formations.

2. Setting of the Invention

In order to more completely drain older hydrocarbon bearing formations, it is now becoming common for an operator to drill one or more lateral boreholes from an existing wellbore. These lateral boreholes extend outwards from the existing wellbore at different depths and over different lengths to recover hydrocarbon fluids from one or more hydrocarbon bearing formations. Since each formation may have different reservoir conditions, as well as different fluid characteristics, there is a need to control the flow of fluids from each of the lateral boreholes and the existing borehole.

Currently, the control of the fluid recovery from these lateral wellbores is accomplished by placing a plurality of adjustable chokes, valves or sliding sleeves along a production tubing set within the wellbore adjacent each lateral wellbore. Each lateral wellbore is fluidicly isolated by placing production packers across the main wellbore between each lateral wellbore. Fluids from each lateral wellbore pass through the respective valve and into the production tubing, and are then recovered to the earth's surface. Control of the recovery of the fluids from each lateral wellbore is accomplished from the earth's surface by the independent opening and closing of the downhole valves in response to the fluid mixtures recovered to the earth's surface or by downhole sensors.

Additional control of the fluid recovery from the wellbore is provided by controlling the fluid production rate of a pumping system set within the wellbore, such as traveling valve pump or an electric submergible pumping system. The primary way to control the fluid production rate is by adjusting the speed of the pump's motor.

A significant problem with the foregoing fluid recovery systems is that a single pump has been used and thereby there is a limited draw down pressure available across all of the lateral wellbores. As each downhole valve is opened necessarily there is a reduction of the draw down pressure available for that and the other lateral wellbores. There is a need for a fluid recovery system that will allow fluid recovery from each lateral wellbore to be independently controlled and also provide adequate draw down pressure for each lateral wellbore.

SUMMARY OF THE INVENTION

The present invention is intended to overcome the foregoing deficiencies and meet the above described needs. Specifically, the present invention is a wellbore fluid recovery system for recovering fluid from a wellbore, and more specifically from a wellbore that has at least one lateral wellbore extending out therefrom. The system includes a first electric submergible pumping system for recovering fluids from a first zone of a wellbore, and a second electric submergible pumping system for recovering fluids from a second zone of the wellbore, such as from a lateral wellbore. Automated control mechanisms are used for independently regulating fluid flow from the first and the second electric submergible pumping systems. Such control mechanisms include automated downhole adjustable valves and variable speed electric motor controllers.

With the fluid recovery system of the present invention the significant prior problem of limited draw down pressure is eliminated because a plurality of independently operated and fluidicly isolated pumping units are placed in the wellbore. Thus, as each downhole valve is opened there is no reduction of the draw down pressure available for that and the other lateral wellbores.

DETAILED DESCRIPTION OF THE PREFERRED EMBODIMENTS

As has been briefly described above, the present invention is a wellbore fluid recovery system for use in recovering fluids from more than one zones within a wellbore or from multiple wellbores. The system generally comprises a first pump unit for recovering fluids from a first zone of the wellbore, and a second pump unit for recovering fluids from a second zone of the wellbore. Automated control mechanisms are provided for managing the recovery of fluids from the first zone independently of the recovery of fluids from the second zone.

Figure 1:
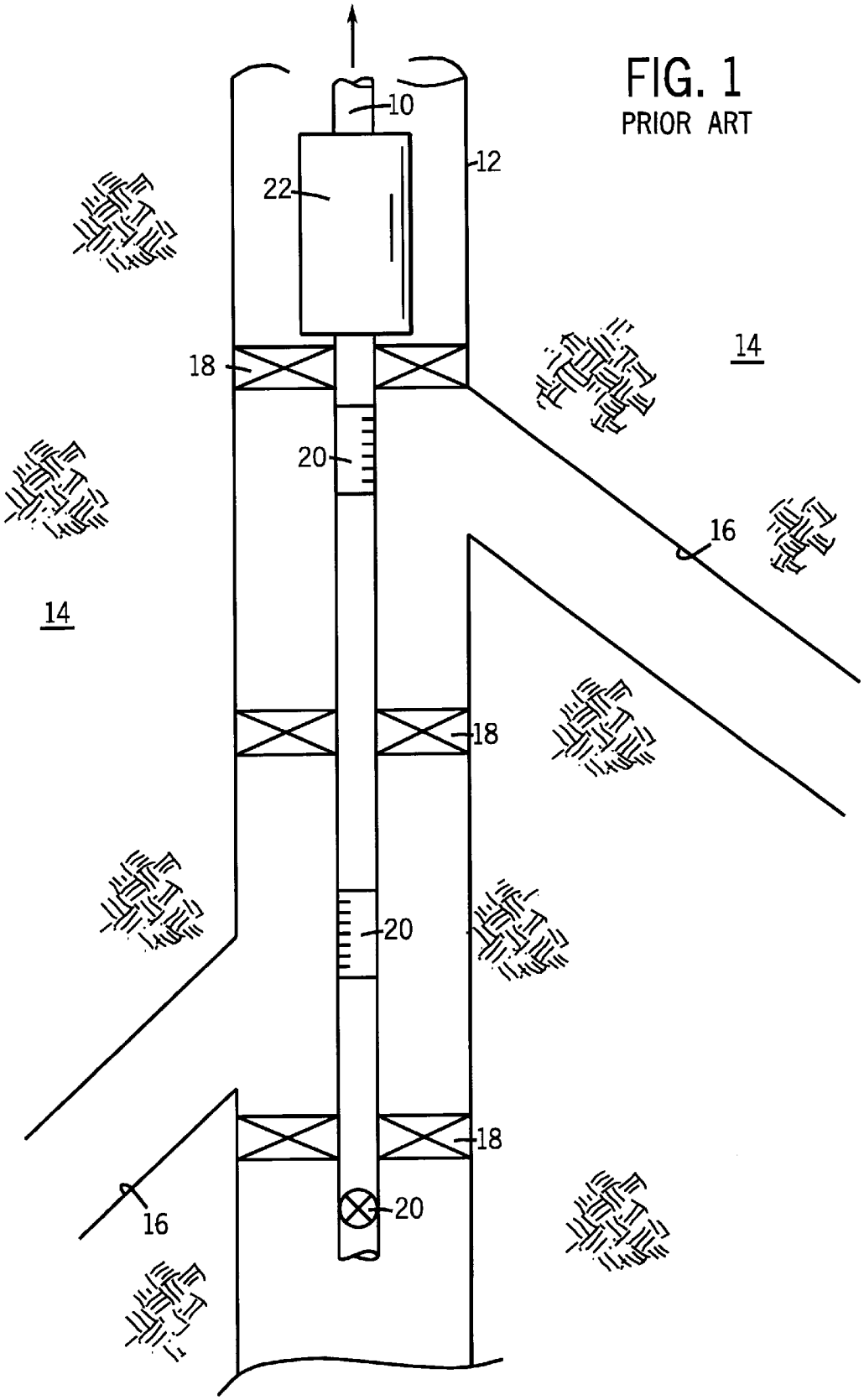
FIG. 1 PRIOR ART
FIG. 1 is a side elevational view of a prior art fluid recovery system disposed within a wellbore.

To better understand the present invention, reference is made to FIG. 1, which shows a prior art fluid recovery system. This prior art recovery system consists of a production tubing string 10 set within a casing 12 that penetrates a plurality of fluid bearing subterranean earthen formations 14. Extending out from the casing 12 are a plurality of spaced, lateral wellbores 16. The production tubing 10 is fluidicly divided into different zones by a plurality of packers 18, and fluid recovery from each zone is controlled by the opening and closing of chokes, valves and/or sliding sleeves 20. If reservoir pressures are insufficient to recover fluids through the tubing 10 to the earth's surface, then an electric submergible pumping system 22 is used.

A significant problem with the foregoing fluid recovery system is that the single pump 22 has a limited draw down pressure available across all of the lateral wellbores 16. As each downhole valve 20 is opened necessarily there is a reduction of the draw down pressure available for that lateral wellbore and the other lateral wellbores 16. If a tandem or second pump was installed, there would be a second tubing string used or the fluids from the second pump would be recovered up the annulus between the outside of the tubing string 10 and the casing 12. Often times a second tubing string 10 for the second pump cannot be placed within the casing 12 because of space constraints. Even if the fluids from the second pump are recovered through the annulus, there still is the problem of how to independently control the recovery of fluids in an automated manner to achieve maximum fluid production from each lateral wellbore 16.

Figure 2:
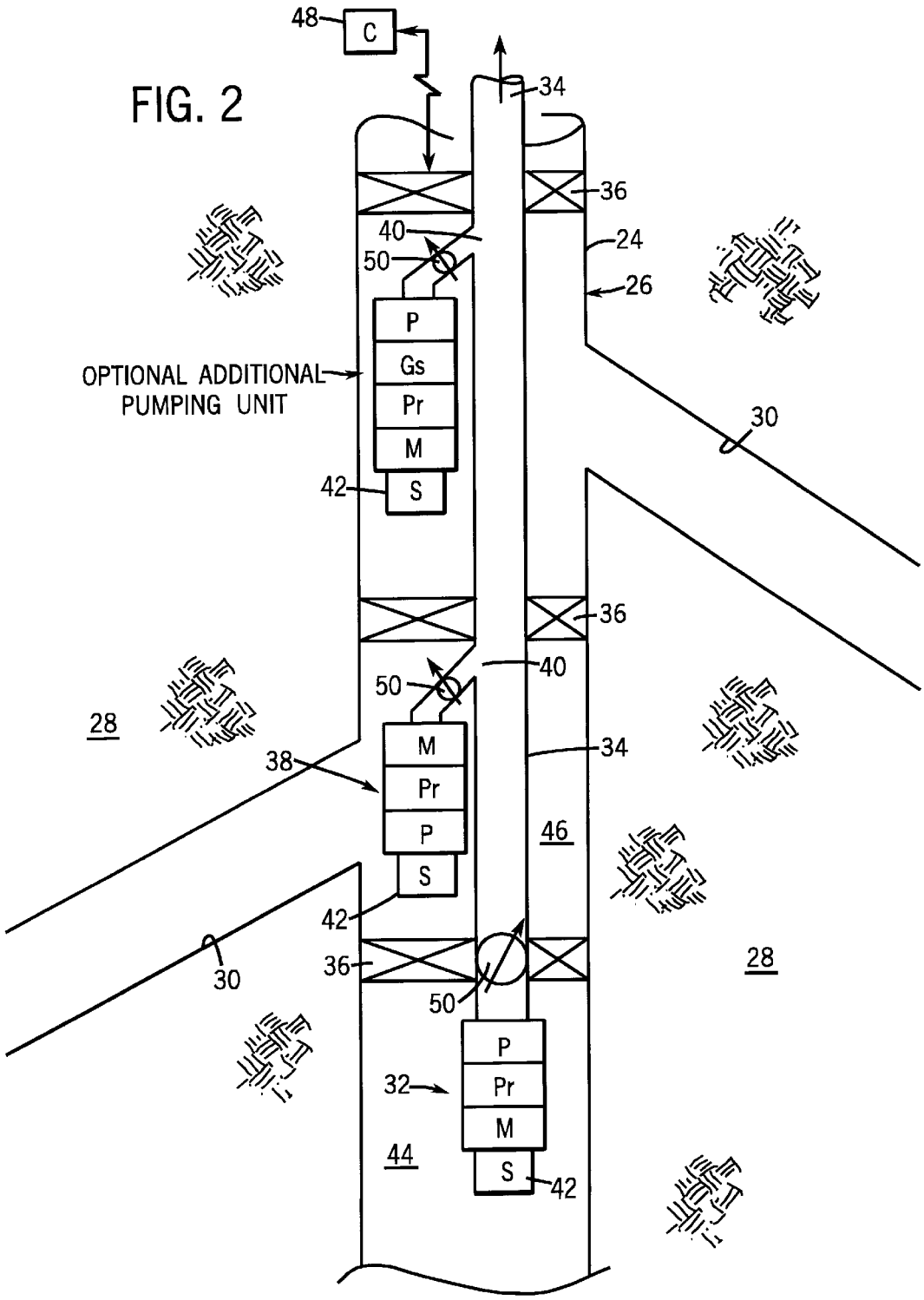
FIG. 2 is a side elevational view of a fluid recovery system of the present invention disposed within a wellbore.

In contrast to the prior art system of FIG. 1, one preferred embodiment of a fluid recovery system of the present invention is shown in FIG. 2. For the purposes of this discussion it will be assumed that "pumping units" referred to are electric submergible pumping systems or "esp's", which generally comprise an electric motor, an oil-filled motor protector and a centrifugal pump. However, the pumping units can be any form of surface driven pumps, such as traveling valve pumps, or other types of downhole fluid moving devices, such as positive displacement pumps, rotary pumps, downhole turbines and motors.

A casing string 24 is set within a wellbore 26 penetrates one or more hydrocarbon bearing subterranean formations 28. One or more lateral wellbores 30 extend out from the casing 24, as is well known by those skilled in the art. A first pumping unit 32, such as an electric submergible pumping system, is landed within the casing 24, with a discharge (not shown) connected to a production tubing string 34 for transporting fluids to the earth's surface. The casing 24 or the production tubing 34 is divided into zones that are fluidicly isolated from one another by one or more wellbore sealing devices, such as elastomeric packers 36, as is well known to those skilled in the art.

Set within or adjacent to one of the lateral wellbores 30 is a second pumping unit 38, which can be of the same type or configuration or size as the first pumping unit 32, or as desired it can be any other type of fluid recovery system. The second pumping unit 38 is connected to the production tubing string 34 by a branched tubing, commonly referred to as a Y-tool 40, as is well known to those skilled in the art. An important feature of the present invention is the use of an automated control means for managing the recovery of fluids from the first zone independently of the recovery of fluids from the second zone. This control means can comprise many different embodiments, but two preferred embodiments will be discussed below.

In one preferred embodiment, one or more sensors 42 are used to sense one or more fluid parameters in a first zone 44 (associated with the first pumping unit 32), or from a second zone 46 (associated with the second pumping unit 38), and preferably from both zones 44 and 46. The one or more parameters sensed can include fluid flow rate, fluid resistivity, fluid temperature, fluid viscosity, water content, oil content, and the like. The sensors 42 can be permanently installed sensors, wireline conveyed logging sensors, or preferably, sensors associated with the pumping units, such as the PSI, DMT, DMST, and PUMPWATCHER products sold by REDA, a division of Camco International Inc. The sensors 42 provide their signals to the earth's surface where programmable digital computers or logic devices 48 are used to determine the proper production flow rates of each pumping unit to achieve a predetermined fluid volume or flow rate from a particular lateral wellbore or for the entire wellbore or of a desired level of water-to-oil ratio from a particular lateral wellbore or for the entire wellbore. In this one preferred embodiment, the signals from the sensors 42 are provided to the earth's surface where the logic device(s) 48 control the operation of a variable speed drive (not shown) for each motor within the pumping units 32 and 38. In turn, the variable speed drives adjust the speed of the motors to adjust the flow rate from each motor, as is well known to those skilled in the art.

In an alternate preferred embodiment, similar to the embodiment described immediately above, the computer systems and logic devices and/or the variable speed drives are located downhole, preferably as part of the sensor packages 42. In this alternate preferred embodiment, a "closed loop" system is provided wherein the flow of fluids from the different wellbores is sensed, any needed changes computed, and action (e.g. adjusting the speed of one or more of the motors) taken all downhole, thereby ensuring the most accurate control for optimum production of the fluids.

In another preferred embodiment, the signals from the sensors 42 are provided to the earth's surface where the logic device(s) 48 control the operation of one or more subsurface chokes, sliding sleeves or adjustable valves 50 mounted in any manner desired to control the fluid flow from one or more of the pumping units and/or from one or more of the lateral wellbores 30. In the embodiment shown in FIG. 2, the valves 50 can be part of the packers 36 or placed out of the fluid flow path of the tubing string 34. Alternately, the computer systems and logic devices and/or the means (not shown) for controlling the operation of the valves 50 are located downhole, preferably as part of an 'intelligent completion system', as are commercially available from Camco Products & Services Company, Halliburton Energy Services, and Schiumberger. In this alternate preferred embodiment, a "closed loop" system is provided wherein the flow of fluids from the different wellbores is sensed, any needed changes computed, and action (e.g. adjusting the position of one or more of the valves 50) taken all downhole, thereby ensuring the most accurate control for optimum production of the fluids.

With the fluid recovery system of the present invention the significant prior problem of limited draw down pressure is eliminated because a plurality of independently operated and fluidicly isolated pumping units are placed in the wellbore. Thus, as each downhole valve is opened there is no reduction of the draw down pressure available for that and the other lateral wellbores.

Whereas the present invention has been described in particular relation to the drawings attached hereto, it should be understood that other and further modifications, apart from those shown or suggested herein, may be made within the scope and spirit of the present invention.

What is claimed:

1. A wellbore fluid recovery system comprising:

a first zone of a wellbore;

a second zone of the wellbore, fluidicly isolated from the first zone of the wellbore;

a first electric submergible pumping system for recovering fluids from the first zone of the wellbore;

a second electric submergible pumping system for recovering fluids from the second zone of the wellbore, the second electric submergible pumping system being displaced from a fluid flow path of the first electric submergible pumping system, wherein the second electric submergible pumping system is connected to one branch of a Y-tool set within the wellbore, and a second branch of the Y-tool is connected to a conduit extending from a discharge of the first electric submergible pumping system;

sensors, providing signals of fluid parameters in the first zone and the second zone of the wellbore; and a control system, that receives the signals of fluid parameters provided by the sensors and automatically and independently operates the first electric submergible pumping system and the second electric submergible pumping system to recover fluids from the wellbore.

2. A wellbore fluid recovery system of claim 1, wherein the control system operates the first electric submergible pumping system from signals provided by sensors reading fluid parameters of the fluid in the first zone of the wellbore.

3. A wellbore fluid recovery system of claim 1, wherein the control system further comprises a downhole adjustable valve for regulating fluid flow from the first electric submergible pumping system.

4. A wellbore fluid recovery system of claim 1, wherein the control system operates the second electric submergible pumping system from signals provided by sensors reading fluid parameters of the fluid in the second zone of the wellbore.

5. A wellbore fluid recovery system of claim 1, wherein the second electric submergible pumping system is displaced from a fluid flow path of the first electric submergible pumping system.

6. The system as recited in claim 1, wherein the first and second electric submergible pumping systems are each comprised of a submergible electric motor drivingly coupled to a submergible pump.

7. The system as recited in claim 6, wherein the control system further comprises a first variable speed drive electrically coupled to the submergible electric motor of the first electric submergible pumping system and a second variable speed drive electrically coupled to the submergible electric motor of the second electric submergible pumping system.

8. A wellbore fluid recovery system, comprising:

a first pump unit for recovering fluids from a first zone of a wellbore;

a second pump for recovering fluids from a second zone of the wellbore, the second pump unit being displaced from a fluid flow path of the first pump unit, wherein the second pump unit is connected to one branch of a Y-tool set within the wellbore, and a second branch of the Y-tool is connected to a conduit extending from a discharge of the first pump unit; and an automated control system to manage the recovery of fluids from the first zone independently of the recovery of fluids from the second zone.

9. A wellbore fluid recovery system of claim 8, wherein a lateral wellbore extends out from the wellbore, with the second pump unit disposed in the wellbore adjacent to the lateral wellbore.

10. A wellbore fluid recovery system of claim 8, wherein a lateral wellbore extends out from the wellbore, with the second pump unit disposed in the lateral wellbore.

11. A method of recovering fluid from a wellbore, comprising:

(a) providing a first electric submergible pumping system within a first zone of a wellbore;

(b) providing a second electric submergible pumping system within a second zone of the wellbore, the second electric submergible pumping system being displaced from a fluid flow path of the first electric submergible pumping system, wherein the second electric submergible pumping system is connected to one branch of a Y-tool set within the wellbore, and a second branch of the Y-tool is connected to a conduit extending from a discharge of the first electric submergible pumping system;

(c) fluidicly isolating the first zone from the second zone;

(d) sensing at least one parameter for the fluid in the first zone and for the fluid in the second zone;

(e) in response to at least one of the sensed parameters, regulating the recovery of fluid from the first zone independently from regulating the recovery of fluid from the second zone.

12. The method of claim 11 wherein the recovery of fluid from the first zone is regulated by operation of a downhole adjustable valve.

13. The method of claim 11 wherein the recovery of fluid from the first zone is regulated by operation of a variable speed motor controller.

* * * * *